US010788038B2

(12) United States Patent
Suzuki et al.

(10) Patent No.: US 10,788,038 B2
(45) Date of Patent: Sep. 29, 2020

(54) CONTROL DEVICE FOR INTERNAL COMBUSTION ENGINE

(71) Applicant: HONDA MOTOR CO., LTD., Minato-Ku, Tokyo (JP)

(72) Inventors: Nobuo Suzuki, Wako (JP); Takeshi Hara, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/560,117

(22) Filed: Sep. 4, 2019

(65) Prior Publication Data

US 2020/0080560 A1 Mar. 12, 2020

(30) Foreign Application Priority Data

Sep. 6, 2018 (JP) ..... 2018-166590

(51) Int. Cl.
*F04C 28/18* (2006.01)
*F01P 3/00* (2006.01)
(Continued)

(52) U.S. Cl.
CPC ..... *F04C 28/18* (2013.01); *F01M 1/02* (2013.01); *F01M 1/16* (2013.01); *F01P 3/00* (2013.01); *F01P 5/10* (2013.01); *F01M 2001/0207* (2013.01); *F01P 2003/006* (2013.01); *F01P 2023/08* (2013.01); *F01P 2025/32* (2013.01);
(Continued)

(58) Field of Classification Search
CPC ..... F04C 28/18; F04C 2270/185; F04C 2270/19; F04C 2270/18; F04C 2270/195; F04C 2270/20; F04C 2270/205; F01M 1/02; F01M 1/16; F01M 2001/0207;
(Continued)

(56) References Cited

U.S. PATENT DOCUMENTS 10,309,275 B2 6/2019 Murakami et al.
2003/0213649 A1 11/2003 Kato
(Continued)

FOREIGN PATENT DOCUMENTS

CN 107725135 A 2/2018
JP 07-127414 A 5/1995
(Continued)

OTHER PUBLICATIONS

Office Action dated Mar. 10, 2020 issued over the corresponding Japanese Patent Application No. 2018-166590 with the English translation thereof.

*Primary Examiner* — Jacob M Amick
(74) *Attorney, Agent, or Firm* — Carrier Blackman & Associates, P.C.; Joseph P. Carrier; William D. Blackman

(57) ABSTRACT

A control device for an internal combustion engine is provided which enables control of dilution of oil by fuel and water drops, i.e., control of the amount of so-called oil dilution. The control device for an internal combustion engine that is lubricated or cooled by oil includes: a variable displacement oil pump capable of varying the amount of discharge of the oil; an air-fuel ratio sensor for sensing an air-fuel ratio of the internal combustion engine; and an ECU for controlling the amount of discharge of the variable displacement oil pump. The ECU controls the amount of discharge of the variable displacement oil pump, based on the air-fuel ratio sensed by the air-fuel ratio sensor.

8 Claims, 5 Drawing Sheets

(51) Int. Cl.
*F01P 5/10* (2006.01)
*F01M 1/02* (2006.01)
*F01M 1/16* (2006.01)

(52) U.S. Cl.
CPC .... *F04C 2270/185* (2013.01); *F04C 2270/19* (2013.01)

(58) Field of Classification Search
CPC ..... F01P 3/00; F01P 5/10; F01P 2003/006; F01P 2023/08; F01P 2025/32
See application file for complete search history.

(56) References Cited

U.S. PATENT DOCUMENTS

| | | | | |
|---|---|---|---|---|
| 2012/0048228 | A1 | 3/2012 | Chung | |
| 2014/0100765 | A1* | 4/2014 | Maki | F01M 1/16 701/113 |
| 2015/0377098 | A1 | 12/2015 | Murakami et al. | |
| 2019/0120096 | A1* | 4/2019 | Dudar | F01M 1/16 |

FOREIGN PATENT DOCUMENTS

| | | | |
|---|---|---|---|
| JP | 2003-336512 | A | 11/2003 |
| JP | 2011-027012 | A | 2/2011 |
| JP | 2014-159760 | A | 9/2014 |
| JP | 2016-011613 | A | 1/2016 |
| JP | 2018-003795 | A | 1/2018 |

* cited by examiner

CONTROL DEVICE FOR INTERNAL COMBUSTION ENGINE

CROSS-REFERENCE TO RELATED APPLICATION

This application is based upon and claims the benefit of priority from Japanese Patent Application No. 2018-166590 filed on Sep. 6, 2018, the contents of which are incorporated herein by reference.

BACKGROUND OF THE INVENTION

Field of the Invention

The present invention relates to a control device for an internal combustion engine that is lubricated or cooled by oil, and to an internal combustion engine control device that is preferable for applications in which a very short drive is repeated in a cold area, for example.

Description of the Related Art

In general, oil viscosity is high under conditions where oil temperature is low, such as during warm-up of the internal combustion engine, and therefore the flow rate of oil supplied from the oil pump to the internal combustion engine is likely to be insufficient, which may cause the performance of the internal combustion engine to go down.

Japanese Laid-Open Patent Publication No. 2018-003795 (hereinafter referred to as JPA 2018-003795) proposes a technique in which the flow rate of oil is increased when the oil temperature is lower than a given temperature. In this technique, the amount of discharge of a variable displacement oil pump is switched from low discharge to high discharge when the oil temperature is lower than the given temperature. This technique suggests that it is then possible to suppress lack of the oil flow rate under conditions where oil temperature is low (see JPA 2018-003795 [0009], [0042]).

SUMMARY OF THE INVENTION

However, indiscriminately increasing the amount of discharge of an oil pump when the oil temperature is lower than a given temperature causes the problem below.

When an internal combustion engine is started at a low oil temperature, e.g., below the freezing point (0° C.), the air-fuel ratio (air/fuel) is controlled on the rich side just after the startup. At this time, if the amount of discharge of oil is increased, the friction of the internal combustion engine increases. When the friction of the internal combustion engine increases, the fuel is set further on the increasing side in order to increase engine torque.

When the fuel is set further on the increasing side, much fuel adheres in the combustion chamber of the internal combustion engine, and the adhered fuel dilutes the oil. Thus, so-called oil dilution (the phenomenon in which fuel and water mix into the oil and dilute the oil) occurs and may impair the function of the oil and worsen fuel consumption and emission.

Especially, when a very short drive is repeated in a cold area at the freezing point or lower temperatures, for example, the fuel does not volatilize from the oil sufficiently and the amount of dilution of the oil by fuel further increases.

The present invention has been devised taking such a problem into consideration, and an object of the present invention is to provide an internal combustion engine control device that is capable of controlling the dilution of oil by fuel and water drops, i.e., controlling the amount of so-called oil dilution.

According to an aspect of the present invention, a control device for an internal combustion engine that is lubricated or cooled by oil, includes:

a variable displacement oil pump configured to vary an amount of discharge of the oil;

an air-fuel ratio sensing unit configured to sense an air-fuel ratio of the internal combustion engine; and a control unit configured to control the amount of discharge of the variable displacement oil pump, wherein the control unit is configured to control the amount of discharge of the variable displacement oil pump, based on the air-fuel ratio sensed by the air-fuel ratio sensing unit.

According to the present invention, it is possible to control dilution of the oil by fuel, i.e., to control the amount of so-called oil dilution, by controlling the amount of discharge of the variable displacement oil pump, based on the air-fuel ratio.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

The control device for an internal combustion engine according to the present invention will now be described in detail in conjunction with preferred embodiments while referring to the accompanying drawings.

Embodiment

[Configuration]

Figure 1:
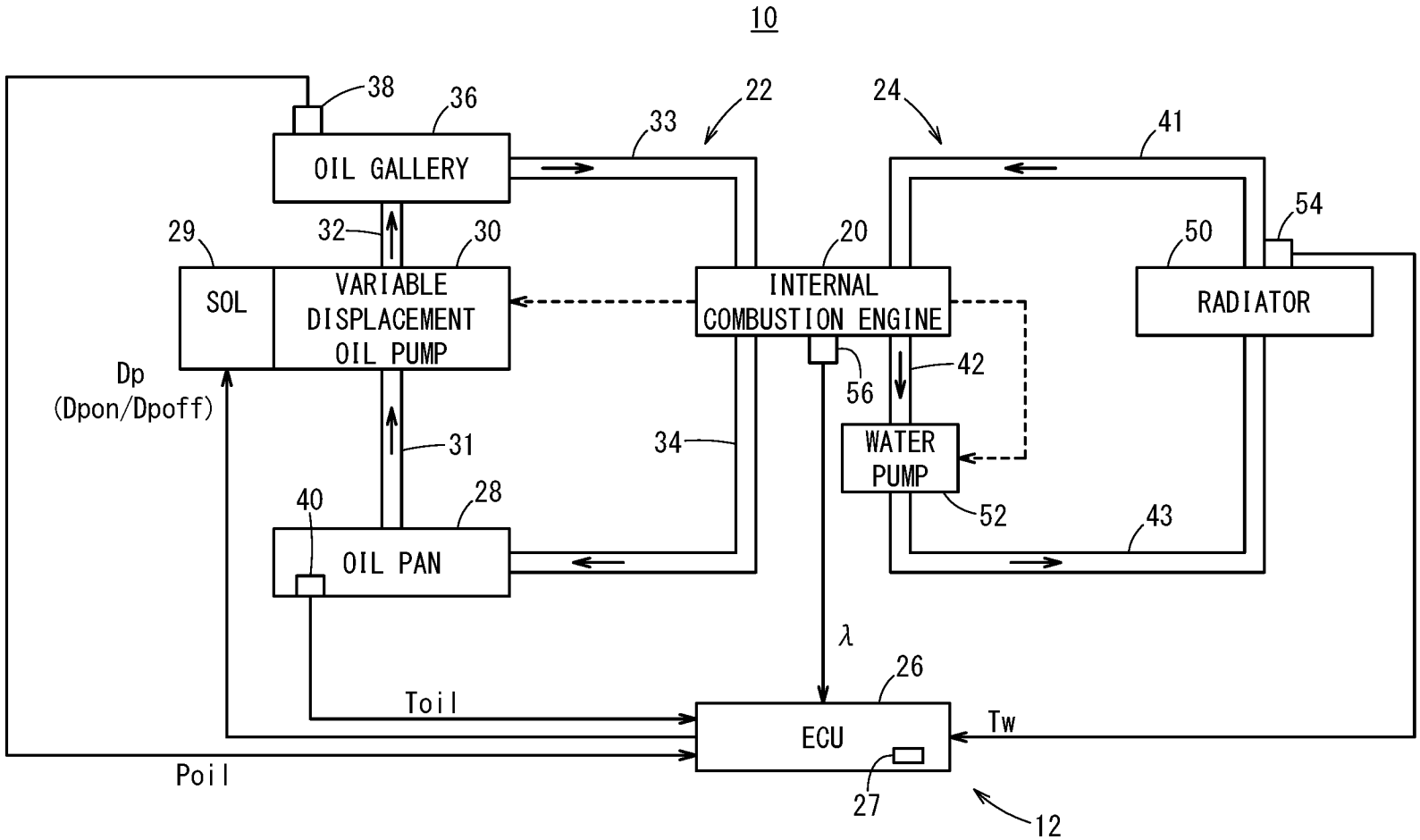
FIG. 1 is a schematic diagram showing the configuration of an internal combustion engine system to which an internal combustion engine control device according to an embodiment is applied.

FIG. 1 is a schematic diagram showing the configuration of an internal combustion engine system 10 to which an internal combustion engine control device 12 of one embodiment is applied.

The internal combustion engine system 10 basically includes an internal combustion engine 20, an oil supply system 22 for supplying oil to the internal combustion engine 20 in a circulating manner, a cooling water supply system 24 for supplying cooling water, e.g., antifreeze like coolant, to the internal combustion engine 20 in a circulating manner, and an ECU (Electronic Control Unit, controlling means) 26 for controlling these elements. The ECU 26 includes a CPU and a storage device 27, such as ROM, RAM, where the CPU executes programs stored in the storage device 27 to function as various functions means (function sections).

The internal combustion engine 20 can be a port fuel injection engine or a direct injection engine.

The oil supply system 22 includes an oil pan 28 in which oil accumulates, a variable displacement oil pump 30 that draws the oil from the oil pan 28 through an oil path 31 and delivers it through an oil path 32, and an oil gallery 36 that distributes the oil supplied from the oil path 32 to different parts in the internal combustion engine 20 through an oil path 33. The oil that has lubricated or cooled various parts in the internal combustion engine 20 is returned to the oil pan 28 through a plurality of passageways (referred to as oil paths) 34 and pooled therein.

An oil pressure Poil of the oil gallery 36 is sensed by an oil pressure sensor 38 and fed to the ECU 26 as a signal.

An oil temperature Toil in the oil pan 28 is sensed by an oil temperature sensor 40 and fed to the ECU 26 as a signal.

Figure 4:
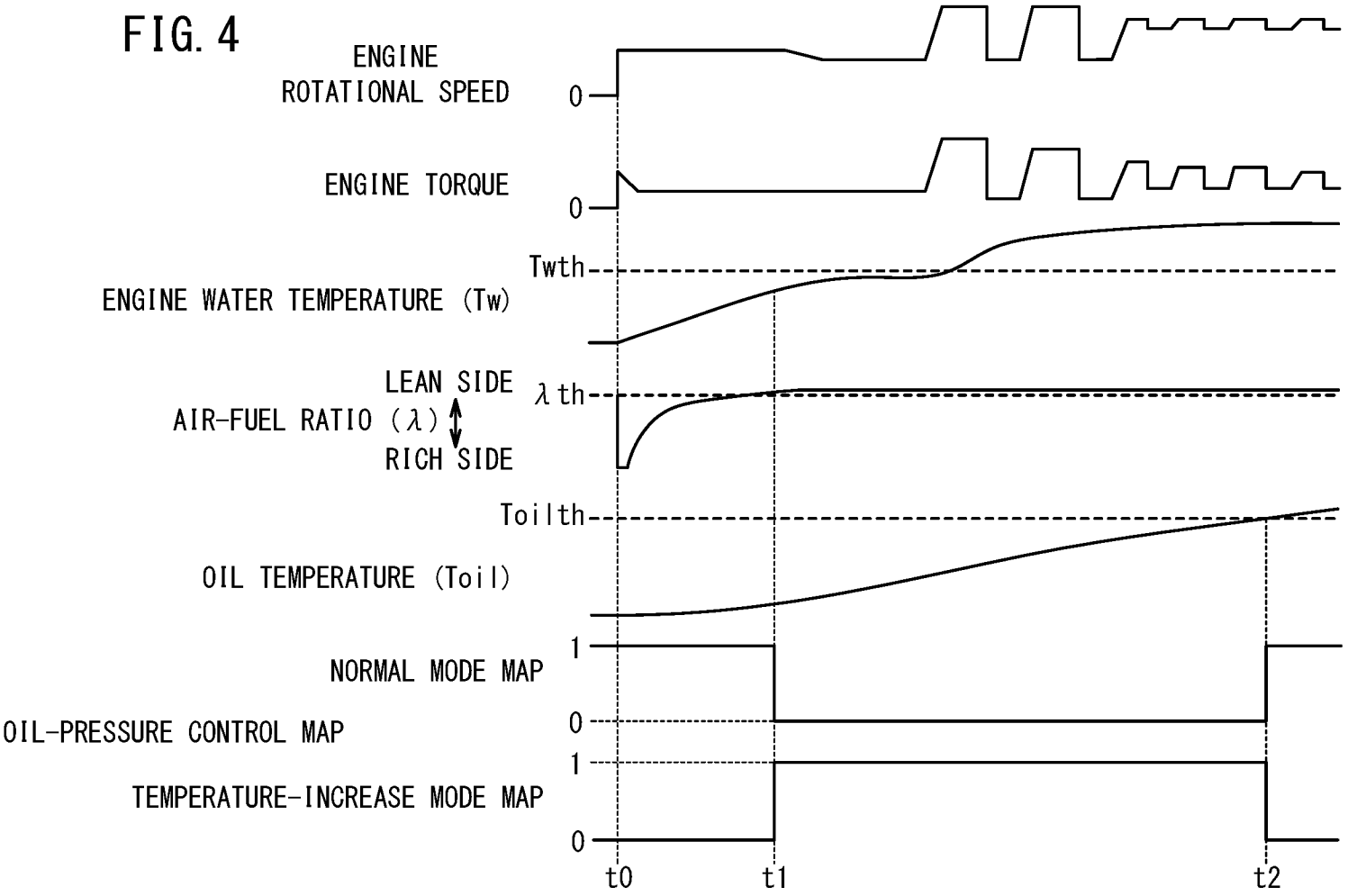
FIG. 4 is a timing chart used to explain the operation of the internal combustion engine control device shown in FIG. 1.

The variable displacement oil pump 30 is a known pump that is capable of varying the amount of oil discharge at two levels of high discharge amount (high oil pressure) and low discharge amount (low oil pressure) in accordance with a drive signal Dp from the ECU 26 (for example, FIG. 4 of JPA 2018-003795).

The variable displacement oil pump 30 includes a solenoid 29 that is ON/OFF controlled by the drive signal Dp, a pilot valve (not shown) having an oil path controlled according to ON/OFF of the solenoid 29, and a vane pump including a hydraulic chamber in which oil pressure is controlled by the stroke of the pilot valve and having an axis rotated by the crankshaft (shown by the broken line arrow directed from the internal combustion engine 20 to the variable displacement oil pump 30).

A drive signal Dpon for turning on the solenoid 29 (a state in which current flows to the solenoid 29) sets a low discharge amount (low oil pressure) control state, and a drive signal Dpoff for turning off the solenoid 29 (a state in which current does not flow to the solenoid 29) sets a high discharge amount (high oil pressure) control state.

The variable displacement oil pump 30 can be a variable displacement oil pump that can vary the amount of discharge linearly and continuously, or a motor-driven pump.

On the other hand, the cooling water supply system 24 includes a radiator 50 for effecting heat exchange of the cooling water as antifreeze, a water path (circulation path) 41 for supplying the cooling water cooled at the radiator 50 to the internal combustion engine 20, a water pump 52 for drawing through a plurality of water paths (water jacket, water gallery) 42 the cooling water that has captured heat from different parts of the internal combustion engine 20 and become hot, and a water path (circulation path) 43 for supplying the hot cooling water to the radiator 50.

A temperature Tw of the cooling water in the radiator 50 (engine water temperature) is sensed by a water temperature sensor 54 and fed to the ECU 26 as a signal.

The water pump 52 is usually driven by the internal combustion engine 20 (shown by the broken line arrow directed from the internal combustion engine 20 to the water pump 52), but can be an electric pump.

The exhaust pipe of the internal combustion engine 20 has an air-fuel ratio sensor 56 attached thereto and the air-fuel ratio sensor 56 checks the concentration of oxygen in the exhaust gas and feeds the air-fuel ratio A to the ECU 26 as a signal.

The internal combustion engine control device 12 of this embodiment is composed of the variable displacement oil pump 30, the air-fuel ratio sensor 56, the water temperature sensor 54, and the ECU 26.

Figure 2A:
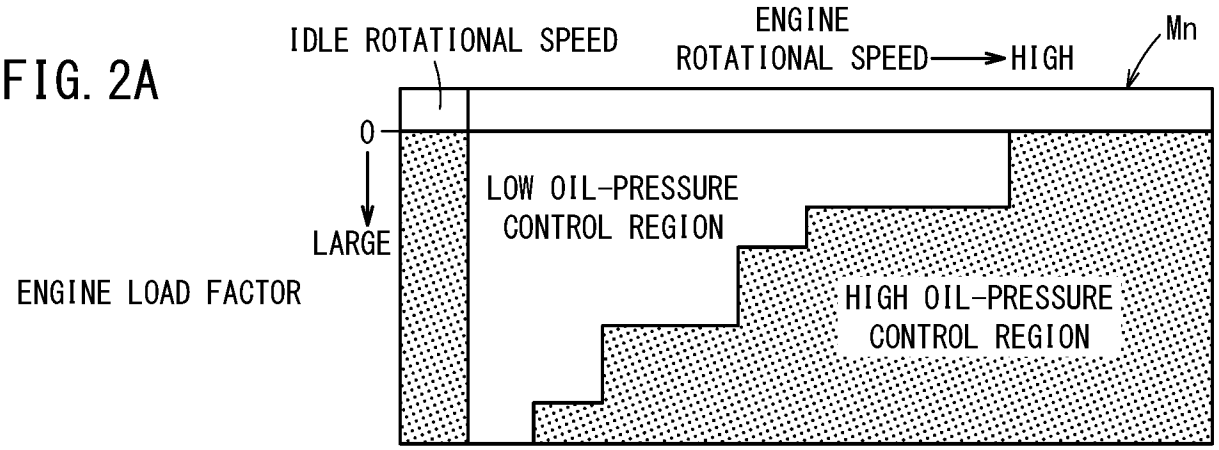
FIG. 2A is a diagram illustrating a normal mode map as an oil-pressure control map.
Figure 2B:
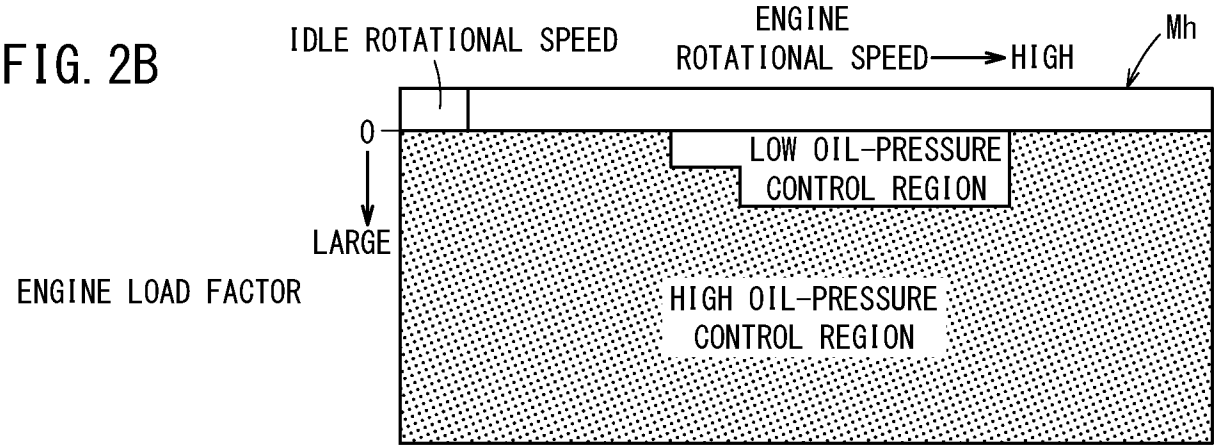
FIG. 2B is a diagram illustrating a high-pressure mode map as an oil-pressure control map.

The storage device 27 of the ECU 26 has stored therein a normal oil-pressure control map Mn shown in FIG. 2A (also called a normal mode map or base map) and a temperature-increase oil-pressure control map Mh shown in FIG. 2B (also called a high-pressure mode map or temperature-increase mode map).

In the maps, the horizontal axis shows the engine rotational speed and the vertical axis shows the engine load factor, where the engine load factor becomes larger as the engine load becomes larger.

As shown in FIG. 2A, the normal mode map Mn is a map that includes: a "low oil-pressure control region" (drive signal Dp=Dpon) where the amount of oil discharge (which is proportional to the oil pressure) is generally kept in a low oil-pressure state when the engine rotational speed (horizontal axis) is intermediate or lower and the engine load factor (vertical axis) is low; and a "high oil-pressure control region" where the amount of oil discharge is generally kept in a high oil-pressure control state when the engine rotational speed and engine load factor are high.

As shown in FIG. 2B, the temperature-increase mode map Mh is a map that includes a "high oil-pressure control region" (drive signal Dp=Dpoff) where the amount of oil discharge is generally kept in a high oil-pressure state regardless of the values of the engine rotational speed and engine load factor.

In the normal mode map Mn of FIG. 2A, a "high oil-pressure control region" is set at idle rotational speeds regardless of the engine load factor, for the purpose of reducing power consumption. At this time, power consumption is reduced because the drive signal Dp for the solenoid 29 is set as drive signal Dpoff.

Also, in the temperature-increase mode map Mh of FIG. 2B, a "low oil-pressure control region" is set when the engine load factor is zero or very low (low load) and the engine rotational speed is intermediate because the necessity of operating the variable displacement oil pump 30 in the "high oil-pressure control region" is low and for the purpose of reducing vibration noise entering the vehicle interior.

[Operations]

Figure 3:
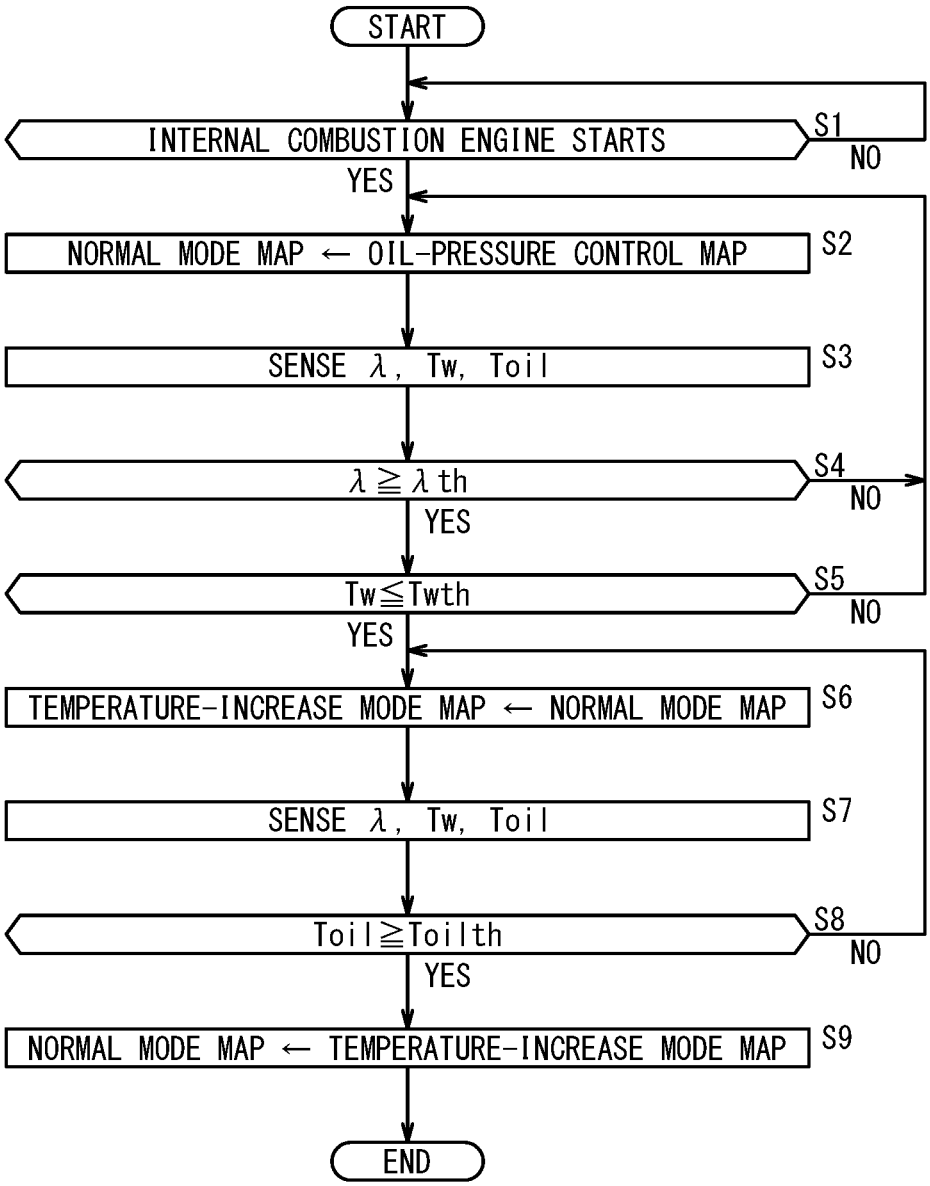
FIG. 3 is a flowchart used to explain operation of the internal combustion engine control device shown in FIG. 1.

Next, operations of the internal combustion engine system 10 to which the internal combustion engine control device 12 basically structured as described above is applied will be explained in detail referring to the flowchart of FIG. 3. The process of the flowchart is executed by the ECU 26 unless otherwise stated. Mention is made of it only where necessary, in order to avoid complexity.

Step S1 monitors whether the internal combustion engine 20 starts; for example, starting of the internal combustion engine 20 is sensed through a starter motor according to a shift of a non-illustrated power switch (ignition switch) from off position to start position (step S1: YES).

In this case, as shown at step S2, the normal mode map Mn is selected as the oil-pressure control map during stoppage before the startup of the internal combustion engine 20. At the startup, the variable displacement oil pump 30 is controlled using the normal mode map Mn. That is, at the startup, the variable displacement oil pump 30 is generally operated in the "low oil-pressure control region".

Next, at step S3, in order to catch timing of starting the switch from the normal mode map Mn to the temperature-increase mode map Mh, the ECU 26 captures and senses the air-fuel ratio λ, engine water temperature Tw, and oil temperature Toil from the air-fuel ratio sensor 56, water temperature sensor 54, and oil temperature sensor 40, respectively.

Next, step S4 determines whether the air-fuel ratio A is on the lean side where it is larger than a given air-fuel ratio λth.

The air-fuel ratio λ is set as λ=1 at the theoretical air-fuel ratio, i.e., stoichiometric. On the rich side where the fuel ratio is larger than at the theoretical air-fuel ratio λ=1, the air-fuel ratio λ is smaller than 1 as λ<1. On the lean side where the air ratio is larger, the air-fuel ratio λ takes a value of 1 or larger as λ≥1. The given air-fuel ratio λth is set as λth=1 at the stoichiometric state, for example, but it may be set on somewhat richer side (λth<1).

Thus, when step S4 determines that the air-fuel ratio λ is still not on the lean side, i.e., when the internal combustion engine 20 is still being controlled on the rich side of the air-fuel ratio λ (λ<λth) (step S4: NO), the variable displacement oil pump 30 is driven generally in the "low oil-pressure control region" in the normal mode map Mn of step S2.

While the internal combustion engine 20 is controlled by repeating step S2→S3→S4: NO→S2 after the startup at step S1, then the internal combustion engine 20 is just after the startup and the air-fuel ratio λ is controlled on the rich side. At this time, if the oil-pressure control map is immediately switched from the normal mode map Mn to the temperature-increase mode map Mh, then the increased amount of oil discharge increases the friction of the internal combustion engine 20 and the air-fuel ratio λ is then set further on the rich side, which may further accelerate oil dilution.

However, according to this embodiment, at startup, when the air-fuel ratio λ is on the rich side (step S4: NO (λ<λth)), the variable displacement oil pump 30 is controlled in the "low oil-pressure control region" in the normal mode map Mn (step S2) so that oil dilution is suppressed.

While the process of step S2→S3→S4: NO→S2 is repeated after the startup at step S1, if the determination at step S4 becomes affirmative (step S4: YES), that is, when the air-fuel ratio λ has become equal to or larger than the given air-fuel ratio λth, then step S5 next determines whether the engine water temperature Tw exceeds a given engine water temperature Twth.

If the engine water temperature Tw is over the given engine water temperature Twth (step S5: NO, Tw>Twth), the internal combustion engine 20 has been warmed up and the oil temperature Toil of the oil, which has a low specific heat, has also increased, and therefore the problem of oil dilution does not occur. Hence, the control of the variable displacement oil pump 30 using the normal mode map Mn at step S2 is continued.

On the other hand, if the air-fuel ratio λ is larger than the given air-fuel ratio λth (step S4: YES) and also the engine water temperature Tw is equal to or less than the given engine water temperature Twth, then the oil temperature Toil is considered to be less than a given oil temperature Toilth at which oil dilution may occur. Then, at step S6, the oil-pressure control map is switched from the normal mode map Mn to the temperature-increase mode map Mh and the drive signal Dp is switched from Dpon to Dpoff so that the variable displacement oil pump 30 is controlled generally in the "high oil-pressure control region" (FIG. 2B).

In this case, the amount of discharge from the variable displacement oil pump 30 increases and an increased amount of oil is delivered from the oil gallery 36 to different parts of the internal combustion engine 20. As the amount of oil discharged increases, the oil receives an increased amount of heat from the internal combustion engine 20 and the oil temperature Toil can be raised rapidly.

Next, at step S7, in order to catch the timing of returning from the temperature-increase mode map Mh to the normal mode map Mn when the oil temperature Toil has increased and the possibility of oil dilution disappeared, the ECU 26 captures and senses the air-fuel ratio λ, engine water temperature Tw, and oil temperature Toil from the air-fuel ratio sensor 56, water temperature sensor 54, and oil temperature sensor 40.

Next, at step S8, it is determined whether the oil temperature Toil has risen to the given oil temperature Toilth that is a high temperature at which oil dilution does not have to be considered (such a temperature that fuel and water mixed in the oil volatilize and vaporize).

The determination of step S8: No→S6→S7→S8 are repeated, and when step S8 determines that the oil temperature Toil has become equal to or higher than the given oil temperature Toilth (step S8: YES), then step S9 switches the oil-pressure control map from the temperature-increase mode map Mh to the normal mode map Mn. The drive signal Dp is thus switched from Dpoff to Dpon and the variable displacement oil pump 30 is stably controlled in the "low oil-pressure control region" when the engine rotational speed is low to intermediate and the engine load factor is relatively low, and in the "high oil-pressure control region" when the engine rotational speed is intermediate to high and the engine load factor is relatively high.

[Explanation with Timing Chart]

An example of the operation described with the flowchart of FIG. 3 will now be explained referring to the timing chart of FIG. 4.

At time t0, the internal combustion engine 20 starts and the engine torque rises. It is assumed that at the time t0 the engine water temperature Tw is much lower than the given engine water temperature Twth, e.g., at a temperature below the freezing point. When the stoppage period is long, the engine water temperature Tw and oil temperature Toil decrease to outside air temperature.

At time t0, the normal mode map Mn is set as the oil-pressure control map (corresponding to step S2).

At the startup at time t0, the air-fuel ratio λ is on a very rich side (λ<λth).

After time t0, the air-fuel ratio λ is set on the lean side and exceeds the given air-fuel ratio λth at time t1 (corresponding to step S4: YES), and if the engine water temperature Tw is equal to or less than the given engine water temperature Twth (corresponding to step S5: YES), then the oil-pressure control map is switched from the normal mode map Mn to the temperature-increase mode map Mh (corresponding to step S6) and the variable displacement oil pump 30 is switched generally from the low oil-pressure control (low discharge) to the high oil-pressure control (high discharge).

After that, time passes and the oil temperature Toil rises past the given oil temperature Toilth at time t2 (corresponding to step S8: YES) and then the oil-pressure control map is switched from the temperature-increase mode map Mh to the normal mode map Mn (corresponding to step S9).

[Comparison Between Conventional Technique, Comparative Example, and Embodiment]

Now, the relation between the operating time of the internal combustion engine 20 after startup and the rise of the oil temperature Toil will be explained referring to FIG. 5 about a conventional technique, comparative example, and embodiment.

Figure 5:
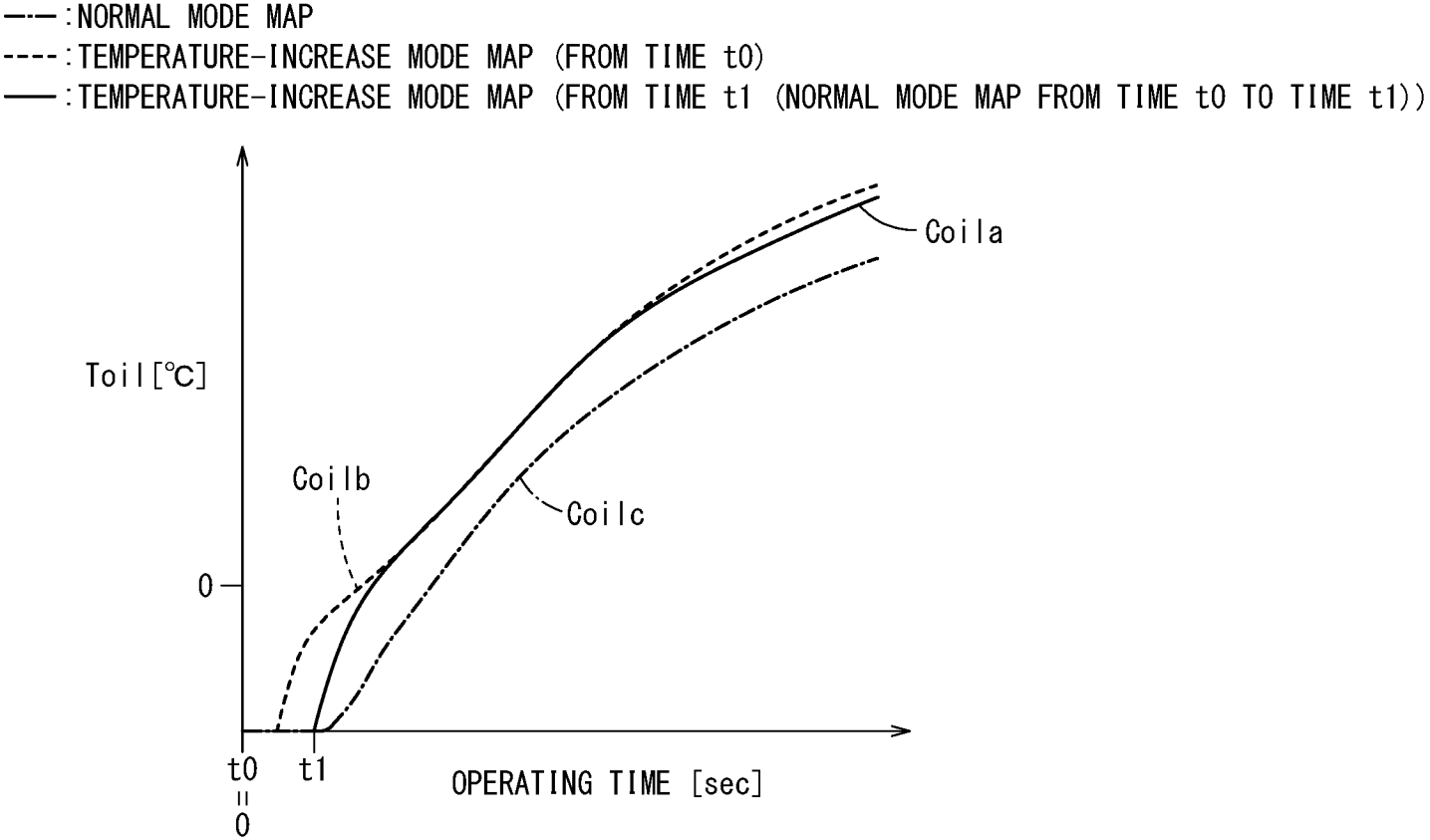
FIG. 5 is a diagram showing characteristics that is used to explain how the oil temperature rises with operating time after startup of the internal combustion engine in a conventional technique, a comparative example, and an embodiment.

In FIG. 5, the characteristic shown by one-dot chain line shows an oil-temperature variation characteristic Coilc of a conventional technique where the variable displacement oil pump 30 is controlled with the normal mode map Mn, the characteristic shown by broken line shows an oil-temperature variation characteristic Coilb of a comparative example where the variable displacement oil pump 30 is controlled with the temperature-increase mode map Mh from time to, i.e., from startup, and the characteristic shown by solid line shows an oil-temperature variation characteristic Coila of the embodiment where the air-fuel ratio λ is considered and the variable displacement oil pump 30 is controlled with the normal mode map Mn from time t0 to time t1 and the variable displacement oil pump 30 is controlled with the temperature-increase mode map Mh after time t1.

The stoppage temperature of the oil temperature [° C.] at the startup time t0 of the operating time 0 [sec] is below the freezing point and the map is switched to the temperature-increase mode map Mh at time t1 at which the temperature is still below the freezing point. At the same operating time after time t1, the oil temperature Toil of the oil-temperature variation characteristic Coila of the embodiment is higher by about 10 [° C.] than the oil temperature Toil of the oil-temperature variation characteristic Coilc of the conventional technique, which shows that the oil temperature Toil can be raised by switching to the temperature-increase mode map Mh.

It is also seen that, at the same operating time after time t1, when the oil temperature Toil is at or above the freezing point (Toil≥0 [° C.]), there is almost no difference between the oil-temperature variation characteristic Coilb of the comparative example (where the temperature-increase mode map Mh is adopted from time t0) and the oil-temperature variation characteristic Coila of the embodiment (where the normal mode map is adopted from time t0 to time t1 and the temperature-increase mode map Mh is adopted from time t1).

Thus, according to the oil-temperature variation characteristic Coila of the embodiment, it is seen that temperature increase of the oil at and after time t1 is ensured while reducing oil dilution (from time t0 to time t1).

[Modification]

When an abnormality of the oil supply system 22 takes place, e.g., when the oil temperature Toil sensed by the oil temperature sensor 40 is abnormally high, or when an abnormality of the cooling water supply system 24 takes place, e.g., when the engine water temperature Tw sensed by the water temperature sensor 54 is abnormally high, the drive signal Dpoff is supplied to the solenoid 29 so as to provide control to increase the amount of oil discharge from the variable displacement oil pump 30. Controlling in this way can prevent degradation of the performance of the internal combustion engine 20.

[Invention Grasped from Embodiment]

The invention that can be grasped from the above-described embodiment and modification will be recited below. The constituent elements are labeled using the reference numerals used in the embodiment in order to facilitate understanding but the constituent elements are not limited to those shown by the reference numerals.

The control device for the internal combustion engine according to the present invention is the control device 12 for the internal combustion engine that is lubricated or cooled by oil, including:

the variable displacement oil pump 30 configured to vary an amount of discharge of the oil;

the air-fuel ratio sensing unit 56 configured to sense the air-fuel ratio λ of the internal combustion engine 20; and the control unit 26 configured to control the amount of discharge of the variable displacement oil pump 30, wherein the control unit 26 is configured to control the amount of discharge of the variable displacement oil pump 30, based on the air-fuel ratio λ sensed by the air-fuel ratio sensing unit 56.

Thus, it is possible to control dilution of the oil by fuel, i.e., to control the amount of so-called oil dilution, by controlling the amount of discharge of the variable displacement oil pump 30, based on the air-fuel ratio λ.

In this case, the control device may further include the temperature sensing unit 54 configured to sense the temperature Tw of the internal combustion engine 20, and the control unit 26 may be configured to control the amount of discharge of the variable displacement oil pump 30, based on the air-fuel ratio λ sensed by the air-fuel ratio sensing unit 56 and the temperature Tw of the internal combustion engine 20 sensed by the temperature sensing unit 54.

Thus, by controlling the amount of discharge of the variable displacement oil pump 30, based on the temperature Tw of the internal combustion engine 20 in addition to the air-fuel ratio λ, it is possible to more reliably control the dilution of the oil by fuel.

In this case, the control unit 26 may be configured to provide control so as to increase the amount of discharge of the variable displacement oil pump 30 when the air-fuel ratio λ is equal to or greater than the given air-fuel ratio λth and the temperature Tw of the internal combustion engine 20 is equal to or lower than the given temperature Twth.

If the air-fuel ratio λ is equal to or greater than the given air-fuel ratio λth, the dilution of the oil by fuel is accelerated. However, the amount of discharge of the variable displacement oil pump 30 is increased if the temperature Tw of the internal combustion engine 20 is equal to or lower than the given temperature Twth, and then the oil receives an increased amount of heat from the internal combustion engine 20. As a result, the temperature of the oil is increased to cause the fuel in the oil to volatilize (transpire) and dilution of the oil is avoided.

The storage device 27 may have stored therein the normal oil-pressure control map Mn adopted to control the amount of discharge of the variable displacement oil pump 30 and the temperature-increase oil-pressure control map Mh adopted to provide control so as to increase the amount of discharge of the variable displacement oil pump 30 more than when the normal oil-pressure control map Mn is adopted, and the control unit 26 may be configured to provide control so as to switch from the normal oil-pressure control map Mn to the temperature-increase oil-pressure control map Mh when the air-fuel ratio λ is equal to or greater than the given air-fuel ratio λth and the temperature Tw of the internal combustion engine 20 is equal to or lower than the given temperature Twth.

When the air-fuel ratio λ is equal to or greater than the given air-fuel ratio λth, dilution of the oil by fuel is accelerated. However, the map is switched to the temperature-increase oil-pressure control map Mh so as to provide control to increase the amount of discharge of the variable displacement oil pump 30 when the temperature Tw of the internal combustion engine 20 is at or lower than the given temperature Twth, and then the oil receives an increased amount of heat from the internal combustion engine 20. As a result, the temperature of the oil is increased to cause the fuel in the oil to volatilize (transpire) and thus dilution of the oil is avoided.

The temperature sensing unit may be the cooling water temperature sensor 54 configured to sense a temperature of cooling water for cooling the internal combustion engine 20.

The temperature of the internal combustion engine 20 is proportional to the temperature Tw of the cooling water for cooling the internal combustion engine 20. Therefore, the temperature Tw of the cooling water, which is easy to sense, can be sensed as the temperature of the internal combustion engine 20.

Preferably, the control device may further include the oil temperature sensing unit 40 configured to sense the temperature Toil of the oil, and the control unit 26 may be configured to stop the control of increasing the amount of discharge of the variable displacement oil pump 30 when the temperature Toil of the oil becomes a temperature equal to or higher than the given temperature Toilth.

Oil dilution does not take place when the temperature Toil of the oil is equal to or higher than the given temperature (a temperature at which fuel in the oil transpires) Toilth. It is therefore preferable to stop the control of increasing the amount of discharge of the variable displacement oil pump 30 so that the friction of the internal combustion engine 20 is reduced.

The control device may further include the oil temperature sensing unit 40 configured to sense the temperature Toil of the oil, and the control unit 26 may be configured to provide control to switch from the temperature-increase oil-pressure control map Mh to the normal oil-pressure control map Mn when the temperature Toil of the oil becomes a temperature equal to or higher than the given temperature Toilth.

Oil dilution does not take place when the temperature Toil of the oil is equal to or higher than the given temperature (a temperature at which fuel in the oil transpires) Toilth. It is therefore preferable to provide control to switch from the temperature-increase oil-pressure control map Mh to the normal oil-pressure control map Mn so that the friction of the internal combustion engine 20 is reduced.

Preferably, the control unit 26 provides control to increase the amount of discharge of the variable displacement oil pump 30 when an abnormality of the system 22 for supplying the oil or the system 24 for supplying the cooling water is sensed.

It is possible to prevent degradation of the performance of the internal combustion engine 20 by providing control to increase the amount of discharge of the variable displacement oil pump 30 when an abnormality of the system 22 for supplying the oil or the system 24 for supplying the cooling water is sensed.

Also, preferably, the control unit 26 is configured to control the variable displacement oil pump 30 using the temperature-increase oil-pressure control map Mh when an abnormality of the system 22 for supplying the oil or the system 24 for supplying the cooling water is sensed.

When an abnormality of the system 22 for supplying the oil or the system 24 for supplying the cooling water is sensed while control is being provided using the normal oil-pressure control map Mn, the map is then switched to the temperature-increase oil-pressure control map Mh. It is thus possible to prevent degradation of the performance of the internal combustion engine 20 by providing control so as to increase the amount of discharge of the variable displacement oil pump 30 using the temperature-increase oil-pressure control map Mh.

The present invention is not limited to the embodiments described above and it is of course possible to employ various configurations based on the description of the invention.

What is claimed is:

1. A control device for an internal combustion engine that is lubricated or cooled by oil, comprising:

a variable displacement oil pump configured to vary an amount of discharge of the oil;

an air-fuel ratio sensing unit configured to sense an air-fuel ratio of the internal combustion engine;

a temperature sensing unit configured to sense a temperature of the internal combustion engine; and a control unit configured to control the amount of discharge of the variable displacement oil pump, wherein the control unit is configured to provide control so as to increase the amount of discharge of the variable displacement oil pump, when the air-fuel ratio sensed by the air-fuel ratio sensing unit is equal to or greater than a given air-fuel ratio and the temperature of the internal combustion engine sensed by the temperature sensing unit is equal to or lower than a given temperature.

2. A control device for an internal combustion engine that is lubricated or cooled by oil comprising:

a variable displacement oil pump configured to vary an amount of discharge of the oil;

an air-fuel ratio sensing unit configured to sense an air-fuel ratio of the internal combustion engine;

a temperature sensing unit configured to sense a temperature of the internal combustion engine;

a storage device configured to store therein a normal oil-pressure control map adopted to control the amount of discharge of the variable displacement oil pump and a temperature-increase oil-pressure control map adopted to provide control so as to increase the amount of discharge of the variable displacement oil pump more than when the normal oil-pressure control map is adopted; and a control unit configured to control the amount of discharge of the variable displacement oil pump, wherein the control unit is configured to provide control so as to switch from the normal oil-pressure control map to the temperature-increase oil-pressure control map when the air-fuel ratio sensed by the air-fuel ratio sensing unit is equal to or greater than a given air-fuel ratio and the temperature of the internal combustion engine sensed by the temperature sensing unit is equal to or lower than a given temperature.

3. The control device for the internal combustion engine according to claim 1, wherein the temperature sensing unit is a cooling water temperature sensor configured to sense a temperature of cooling water for cooling the internal combustion engine, and the control unit provides control so as to increase the amount of discharge of the variable displacement oil pump when an abnormality of a system for supplying the cooling water is sensed.

4. The control device for the internal combustion engine according to claim 1, wherein the control unit is configured to stop the control of increasing the amount of discharge of the variable displacement oil pump when the temperature of the oil becomes a temperature equal to or higher than a given temperature.

5. The control device for the internal combustion engine according to claim 2, wherein the control unit is configured to provide control to switch from the temperature-increase oil-pressure control map to the normal oil-pressure control map when the temperature of the oil becomes a temperature equal to or higher than a given temperature.

6. The control device for the internal combustion engine according to claim 1, wherein the control unit is configured to increase the amount of discharge of the variable displacement oil pump when an abnormality of a system for supplying the oil is sensed.

7. The control device for the internal combustion engine according to claim 2, wherein the control unit is configured to control the variable displacement oil pump using the temperature-increase oil-pressure control map when an abnormality of a system for supplying the oil is sensed.

8. The control device for the internal combustion engine according to claim 2, wherein the temperature sensing unit is a cooling water temperature sensor configured to sense a temperature of cooling water for cooling the internal combustion engine, and the control unit controls the variable displacement oil pump by using the temperature-increase oil-pressure control map when an abnormality of a system for supplying the cooling water is sensed.

* * * * *